US007687214B2

(12) United States Patent
Shibai et al.

(10) Patent No.: US 7,687,214 B2
(45) Date of Patent: Mar. 30, 2010

(54) TWO-COMPONENT DEVELOPER AND IMAGE FORMATION METHOD

(75) Inventors: Yasuhiro Shibai, Yamatokoriyama (JP); Yoritaka Tsubaki, Nara (JP); Keiichi Kikawa, Sakai (JP)

(73) Assignee: Sharp Kabushiki Kaisha, Osaka (JP)

( * ) Notice: Subject to any disclaimer, the term of this patent is extended or adjusted under 35 U.S.C. 154(b) by 286 days.

(21) Appl. No.: 11/252,992

(22) Filed: Oct. 19, 2005

(65) Prior Publication Data

US 2006/0084003 A1 Apr. 20, 2006

(30) Foreign Application Priority Data

Oct. 19, 2004 (JP) ..... 2004-304579

(51) Int. Cl.
*G03G 9/08* (2006.01)

(52) U.S. Cl. ..... 430/108.7; 430/110.4; 430/109.4; 430/123.5

(58) Field of Classification Search ..... 430/110.4, 430/123.5, 108.6, 108.7, 109.4
See application file for complete search history.

(56) References Cited

U.S. PATENT DOCUMENTS

| | | | | |
|---|---|---|---|---|
| 4,737,433 | A * | 4/1988 | Rimai et al. | 430/110.4 |
| 4,904,558 | A * | 2/1990 | Nagatsuka et al. | 430/108.6 |
| 4,985,327 | A | 1/1991 | Sakashita et al. | |
| 5,087,429 | A | 2/1992 | Kamio et al. | |
| 5,120,631 | A * | 6/1992 | Kanbayashi et al. | 430/110.4 |
| 5,320,926 | A * | 6/1994 | Ueda et al. | 430/108.3 |
| 5,529,865 | A * | 6/1996 | Kanbayashi et al. | 430/110.4 |

(Continued)

FOREIGN PATENT DOCUMENTS

| | | |
|---|---|---|
| JP | 2-877 A | 1/1990 |

(Continued)

OTHER PUBLICATIONS

Diamond, Arthur S & David Weiss (eds.) Handbook of Imaging Materials, 2nd ed.. New York: Marcel-Dekker, Inc. (Nov. 2001) p. 180.*

*Primary Examiner*—Christopher RoDee
(74) *Attorney, Agent, or Firm*—Nixon & Vanderhye P.C.

(57) ABSTRACT

A two-component developer and an image formation method for two-component development type are provided. With this developer and this method, even if toners have a small grain diameter and a high density of pigments for economizing the toner consumption, cracking and toner spent caused by the stress from carriers are suppressed, so that less deteriorated and stabler images can be obtained throughout a long time period. The two-component developer includes toner particles containing at least a binding resin and a pigment. A mean volume particle diameter of the toner particles is between 5.5 μm and 7 μm. A number percent of the toner particles with a mean volume particle diameter of 5 μm or below, and a volume percent of the toner particles with a mean volume particle diameter between 8 μm and 12.7 μm, with respect to the total toner particles, respectively, are set to be within a predetermined range. Density of the pigment in the toner particles is between 8 weight percent and 20 weight percent. The two-component developer also includes carrier particles which are resin-coated carrier particles. A mean volume particle diameter of the carrier particles is between 35 μm and 65 μm. The two-component developer allows the formation of less deteriorated and stabler images throughout a long time period.

3 Claims, 1 Drawing Sheet

U.S. PATENT DOCUMENTS

| | | | | | |
|---|---|---|---|---|---|
| 5,547,796 | A | * | 8/1996 | Kohtaki et al. | 430/110.4 |
| 5,712,070 | A | * | 1/1998 | Nozawa et al. | 430/110.4 |
| 5,738,962 | A | * | 4/1998 | Ichimura et al. | 430/110.4 |
| 5,804,351 | A | | 9/1998 | Takano et al. | |
| 5,849,453 | A | * | 12/1998 | Mikuriya et al. | 430/110.4 |
| 5,976,750 | A | * | 11/1999 | Hagi et al. | 430/110.4 |
| 6,183,926 | B1 | * | 2/2001 | Kuroda et al. | 430/110.4 |
| 6,258,502 | B1 | * | 7/2001 | Nakamura et al. | 430/110.4 |
| 6,284,424 | B1 | * | 9/2001 | Iimura et al. | 430/110.4 |
| 6,395,443 | B2 | * | 5/2002 | Kuroda et al. | 430/110.4 |
| 6,868,252 | B2 | * | 3/2005 | Akiba | 430/110.4 |
| 6,873,814 | B2 | * | 3/2005 | Ohjimi et al. | 430/110.4 |
| 6,991,884 | B2 | * | 1/2006 | Sun et al. | 430/110.4 |
| 2003/0073021 | A1 | * | 4/2003 | Sasaki et al. | 430/110.4 |
| 2003/0219671 | A1 | * | 11/2003 | Tanma et al. | 430/110.4 |
| 2005/0158648 | A1 | * | 7/2005 | Makino et al. | 430/110.4 |
| 2006/0084002 | A1 | * | 4/2006 | Shibai et al. | 430/110.4 |

FOREIGN PATENT DOCUMENTS

| | | | |
|---|---|---|---|
| JP | 2-284150 | A | 11/1990 |
| JP | 2-284151 | A | 11/1990 |
| JP | 06-059494 | | 3/1994 |
| JP | 7-181747 | A | 7/1995 |
| JP | 7-248638 | A | 9/1995 |
| JP | 9-68823 | A | 3/1997 |
| JP | 2000-242030 | A | 9/2000 |
| JP | 2003-287918 | A | 10/2003 |
| JP | 2004-198554 | A | 7/2004 |

* cited by examiner

TWO-COMPONENT DEVELOPER AND IMAGE FORMATION METHOD

This Nonprovisional application claims priority under 35 U.S.C. §119(a) on Patent Application No. 2004/304579 filed in Japan on Oct. 19, 2004, the entire contents of which are hereby incorporated by reference.

FIELD OF THE INVENTION

The present invention relates to a two-component developer used for an image formation device such as an electrophotographic copier or a printer. Particularly, the present invention relates to a two-component developer capable of preventing a decrease in image density and fog, over a long period of time.

RELATED ART AND OTHER CONSIDERATIONS

An electrophotographic method is divided roughly into two types of methods: a single-component development method and a two-component development method. The two-component development method is widely used in current image formation devices because it is an advantageous method allowing high-speed development, compared with the single-component development method. Among various types of two-component development methods, the two-component development method using a magnetic brush is widely used because it allows high-quality images to be produced, color printing to be realized, and inexpensive toners to be used, etc., compared with other development methods. In the following, a typical developer employed for the two-component development method is described in the context of the two-component development method using a magnetic brush.

The typical developer used in the two-component development method such as the two-component development method using a magnetic brush includes toner particles containing colorant and magnetic carrier particles. The toner particles and the magnetic carrier particles are stirred when used for development. The toner particles and the carrier particles are frictionally charged by being stirred, so that the toner particles are adsorbed onto the surface of the carrier particles by the frictional charge.

The two-component developer thus frictionally charged is supplied onto a developing sleeve which has an internal magnet. At this time, the carrier particles on the developing sleeve are attracted by the magnetic power of the internal magnet and linked to each other as a chain from the surface of the developing sleeve, so as to form a magnetic brush. Maintaining its state, the developer is conveyed by the developing sleeve onto a photoreceptor having an electrostatic latent image thereon.

Subsequently, the two-component developer as a magnetic brush is rubbed on the surface of the photoreceptor. The charged toner particles are transferred onto the photostatic latent image surface by the coulomb power which is derived from the potential difference between the photostatic latent image surface and the charged toner, thereby forming a toner image. The magnetized carrier particles, on the other hand, remain on the developing sleeve, as they are attracted by the inner magnet within the developing sleeve. As a subsequent stage, a toner image on the photostatic latent image surface is transferred onto a sheet of transfer paper, etc, and then fused on it, thereby completing image formation.

In this type of two-component development method, the toner particles in the two-component developer are continually exposed to stress by being stirred with the carrier particles. Therefore, the toner particles in the two-component developer tend to break over the long time period of being stirred, so that toner spent and fog are caused, resulting in a deterioration of image quality. This phenomenon becomes more noticeable, if a rate of stirring is increased in order to increase the rate of rise in charge, or to realize high-speed development, which would increase the stress to the toner particles at the time of the stirring.

On the other hand, toner particles with small diameters and with high density of pigment have been found to be desirable in recent years so as to improve image quality and to economize on toner consumption. However, toner particles with small diameters are easily aggregated and are easily scattered, which could cause toner spent and fog. Thus diameters of toner particles are required to be controlled appropriately. In addition, toner particles with high densities of pigments crack easily at the interface with the pigments. Hence the toner particles with small diameters are less durable. Therefore, as the number of toner particles with small diameters increases during extended periods of operation, toner filming or fog is more easily caused.

In order to avoid the problem mentioned above, and to improve the image quality in the case of using toner particles with small diameters, Reference 1, for example, proposes a technology to use a developer in which the grain size distribution of toner particles is controlled within a specific range. More specifically, Reference 1 discloses a technology to obtain a two-component developer by mixing toner particles and carrier particles coated with resin, where: mean volume particle diameter of the toner particles lies in the range between 3 μm to 9 μm, and its grain size distribution is set to satisfy predetermined parameters.

Reference 2 proposes a two-component developer in which the number of smaller toner particles is increased compared to the toner particles disclosed in Reference 1, and in which the number of the toner particles with a diameter of 5 μm or below, and the number of the toner particles with a diameter between 8 μm and 12.7 μm are controlled.

Reference 3 proposes toner particles of which grain diameter distribution per number has a peak value or the maximum value between 1.0 μm and 2.0 μm.

If toner particles with narrow grain size distribution are employed, however, as in the case of the two-component developer disclosed in Reference 1, a formed image typically tend to lack in sharpness. Also such toner particles are of disadvantage in terms of durability as they are homogenously exposed to stress.

In the case of References 2 and 3, a large amount of small particles and a small amount of coarse particles are included. Employing such toner particles are advantageous with respect to the sharpness of an image, but are disadvantageous with respect to durability because the presence of small particles affects the durability of toner particles. Therefore, further improvement has been required.

If both of the toners disclosed in References 1 and 2 have a low density of pigments, the above-mentioned problems are relatively less noticeable. However for toner particles with high pigment density employed for performing high-speed development, the influence of the above-mentioned problems is not negligible, such that the development so as to avoid the above-mentioned problems is strongly desired.

Reference 1: Japanese Unexamined Patent Publication No. 68823/1997 (Tokukaihei 9-68823) published on Mar. 11, 1997

Reference 2: Japanese Unexamined Patent Publication No. 877/1990 (Tokukaihei 2-877) published on Jan. 5, 1990

Reference 3: Japanese Unexamined Patent Publication No. 287918/2003 (Tokukai 2003-287918) published on Oct. 10, 2003

BRIEF SUMMARY

The present invention is made in view of the above-mentioned problems, and to provide a two-component developer and an image formation method as a two-component development method, where even with respect to toners having small diameters and a high density of pigments for economizing the toner consumption, cracking and toner spent caused by the stress from carrier particles are suppressed so that less deteriorated and stabler images can be obtained, even throughout a long time period.

In order to achieve the object, a two-component developer as described herein has the following characters. The two-component developer includes toner particles and carrier particles. The toner particles contain at least a binding resin and a carbon black pigment. A mean volume particle diameter of the toner particles is between 5.5 μm and 7 μm, and a number percent of toner particles with a mean volume particle diameter below 5 μm, with respect to the total toner particles, is in the range up to the limit represented by a numerical expression (1). A volume percent of the toner particles with a mean volume particle diameter between 8 μm and 12.7 μm, with respect to the total toner particles, is in the range between an upper limit represented by a numerical expression (2) and a lower limit represented by a numerical expression (3). The density of the carbon black pigments in the toner particles is between 8 weight percent and 20 weight percent. The carrier particles are resin coated carrier particles, and a mean volume particle diameter of the carrier particles is between 35 μm and 65 μm.

$$y=-15x+136 \quad (1),$$

$$n=15m-75 \quad (2), \text{ and}$$

$$n=7m-75 \quad (3),$$

in which x represents a mean volume particle diameter;

y represents a number percent of toner particles with a mean volume particle diameter below 5 μm;

m represents a mean volume particle diameter; and n represents a volume percent of toner particles with a mean volume particle diameter between 8 μm and 12.7 μm, respectively.

With respect to the toner particles used in the two-component developer, if the ratio of toner particles with a mean volume particle diameters below 5 μm is above the above-mentioned upper limit, toner spent to the carrier particles are easily caused due to the presence of too much amount of fine powders, so that a charged level is changed or fog is caused. Accordingly, image quality is deteriorated.

In addition, if the ratio of the toner particles with a mean volume particle diameter being between 8 μm and 12.7 μm is above the above-mentioned upper limit, the resolution becomes low due to the presence of too many coarse particles, resulting in a deterioration of image quality. On the other hand, if the ratio of the toner particles with a mean volume particle diameter being between 8 μm and 12.7 μm is below the above-mentioned lower limit, the durability of toner particles is low, resulting in the deterioration of the image quality during extended periods of operation.

Furthermore, if a grain diameter of each of the carrier particles is below 35 μm, the carrier particles tend to be scattered, resulting in image quality deterioration. On the other hand, if a grain diameter of each of the carrier particles is above 65 μm, the entire surface of the carrier particles becomes too small with respect to the small toner particles with grain diameters between 5.5 μm and 7 μm, such that the toner particles cannot be frictionally charged in a homogeneous fashion. In particular, when the amount of fine powders increases during extended periods of operation, the influence due to this problem becomes noticeable, so that fog tends to occur easily.

Accordingly, by employing the two-component developer as described herein and having the above-mentioned arrangement, even if toners having small grain diameters and a high density of pigments for economizing the toner consumption are included, cracking and toner spent caused by the stress from carrier particles are suppressed so that less deteriorated and stabler images can be obtained throughout a long time period.

In order to achieve the object, an image formation method according to the present invention, is an image formation method which includes: forming a latent image on a latent image carrier; forming a toner image on the latent image carrier, using a developer provided on a developer holding member; transferring the toner image onto an image supporting member; and fusing the toner image on the image supporting member. The developer has the following characteristics. A two-component developer includes toner particles and carrier particles. The toner particles contain at least a binding resin and a carbon black pigment. A mean volume particle diameter of the toner particles is between 5.5 μm and 7 μm. A number percent of the toner particles with a mean volume particle diameter of 5 μm or below, with respect to the total toner particles, is in the range up to the limit represented by a numerical expression (1). Volume percent of the toner particles with a mean volume particle diameter between 8 μm and 12.7 μm, with respect to the total toner particles, is in the range between an upper limit represented by a numerical expression (2) and a lower limit represented by a numerical expression (3). The density of the carbon black pigments in the toner particles is between 8 weight percent and 20 weight percent. Carrier particles are resin coated carrier particles. A mean volume particle diameter of the carrier particles is between 35 μm and 65 μm.

$$y=-15x+136 \quad (1),$$

$$n=15m-75 \quad (2), \text{ and}$$

$$n=7m-37 \quad (3),$$

in which x represents a mean volume particle diameter;

y represents a number percent of toner particles with a mean volume particle diameter of 5 μm or below;

m represents a mean volume particle diameter; and n represents a volume percent of toner particles with a mean volume particle diameter between 8 μm and 12.7 μm, respectively.

By employing the above-mentioned method, even if toners having small grain diameters and a high density of pigments for economizing the toner consumption are used, cracking and toner spent caused by the stress from carrier particles are suppressed such that less deteriorated and stabler images can be obtained throughout a long time period.

Other objects, characters, and advantages of the present invention would be understood from the following description. The merit of the present invention will be apparent from the description below in reference to the accompanying drawings.

BRIEF DESCRIPTION OF THE DRAWINGS

FIG. 1(*b*) is a graph with a vertical axis showing a volume percent of toners particles with a mean volume particle diameter between 8 μm and 12.7 μm, and with a horizontal axis showing a mean volume particle diameter, where values of the examples 1 through 13 and values of comparative examples 1 through 21 are plotted.

DESCRIPTION OF THE EMBODIMENTS

Figure 1:
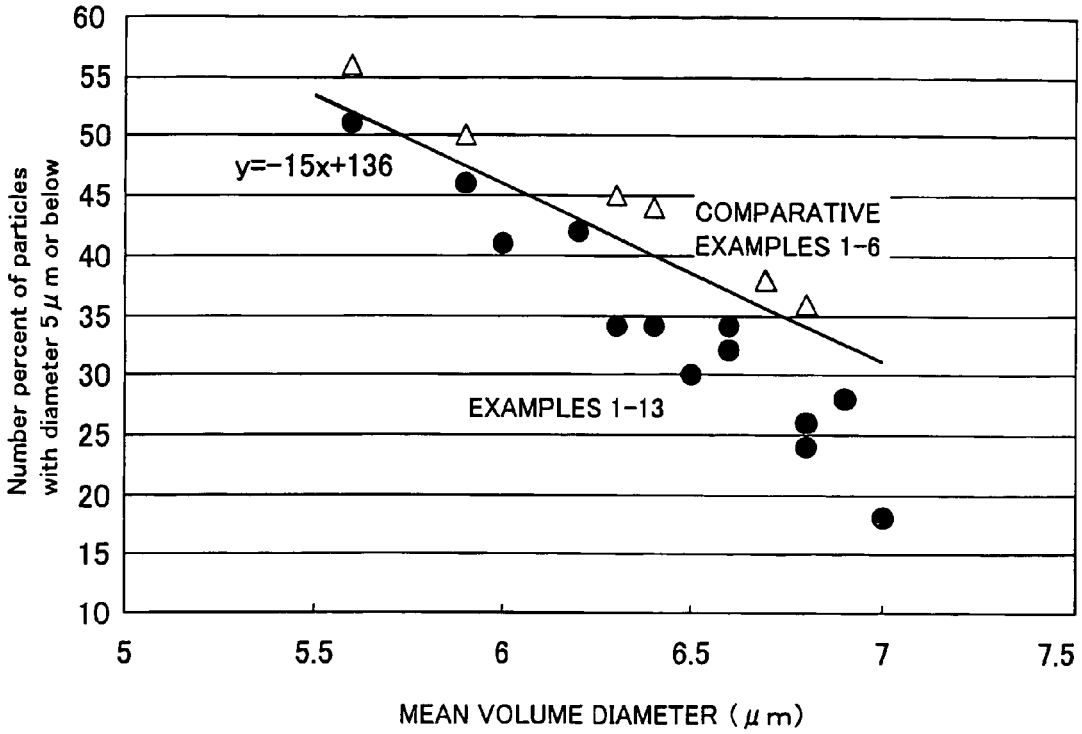
FIG. 1(*a*) is a graph with a vertical axis showing a number percent of toner particles with a mean volume particle diameter of 5 μm or below, and with a horizontal axis showing a mean volume particle diameter, where values of the examples 1 through 13 and values of comparative examples 1 through 6 are plotted.
Figure 1:
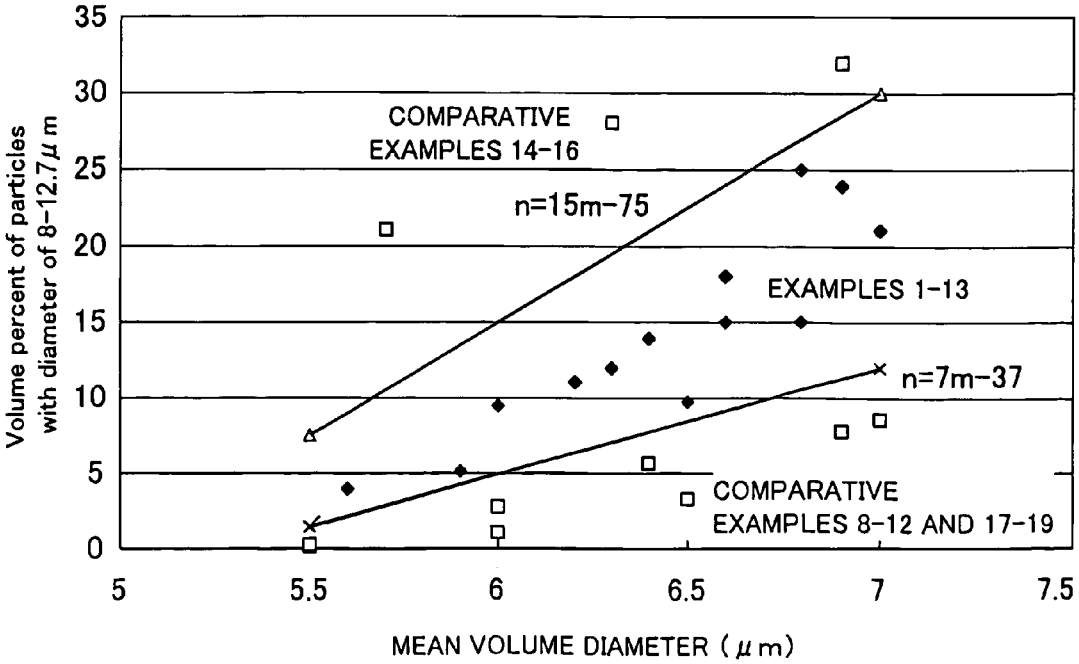

An embodiment according to the present invention is described below. A two-component developer according to the present invention includes toner particles and carrier particles, and the toner particles contain at least a binding resin and a carbon black pigment. In other words, the toner particles according to the present invention include binding resin and pigment as their primary components, and charge controlling agents, waxes or the like may be added, if necessary.

As the binding resin employed for the toner particles according to the present invention, a binding resin can be selected from a large group of applicants including known resins. Some of the examples are homopolymers and copolymers of styrenes such as styrene, chlorostyrene, and the like; homopolymers and copolymers of monoolefins such as ethylene, propylene, butylene, isobutylene and the like; homopolymers and copolymers of vinylesters such as vinyl acetate, vinyl propionate, vinyl benzoate, vinyl butyrate, and the like; homopolymers and copolymers of esters of α-methylene aliphatic monocarboxylic acid such as methyl acrylate, ethyl acrylate, butyl acrylate, octyl acrylate, dodecyl acrylate, phenyl acrylate, methyl methacrylate, ethyl metacrylate, butyl metacrylate, dodecyl acrylate, and the like; homopolymers and copolymers of vinyl ethers such as vinyl methyl ether, vinyl ethyl ether, vinyl butyl ether and the like; homopolymers and copolymers of vinyl ketones such as vinyl methyl ketone, vinyl hexyl ketone, vinyl isopropenyl ketone and the like; copolymers of styrene-alkyl acrylate; copolymers of styrene-alkyl methacrylate; copolymers of styrene-acrylilonitrile; copolymers of styrene-butadiene; copolymers of styrene-maleic anhydride; polyolefins such as polyethylene, polypropylene, and the like. In addition, polyester, polyurethane, epoxy resin, silicone resin, polyamid, denatured rosin, paraffin wax, and the like may be employed. Typical examples of binding resins are styrene resins such as polystyrene and copolymers of styrene-acrylic acid ester, vinyl chloride resin, phenol resin, epoxy resin, polyester resin, polyurethane resin, polyvinyl butyral resin and the like. One of the resins may be used independently, or a combination of more than two of them may be used.

In those resins, crystalline waxes or non-compatible substances may be fine-dispersed at the synthesis stage. The resin is particularly preferably constituted of polyester resin or polyether polyol resin as primary components, which are advantageous in thermal characteristics such as resin elasticity.

Carbon black pigment used in the toner particles of the present invention may be non-processed pigment or pigment with its surface processed by a resin. In addition to the carbon black, black pigments such as copper oxide, manganese dioxide, aniline black, activated carbon, nonmagnetic ferrite, magnetic ferrite, magnetite, and the like may be used in combination with the carbon black.

A density of the carbon black pigment in the toner particles of the present invention is preferably between 8 weight percent and 20 weight percent, more preferably between 10 weight percent and 15 weight percent. If the density is 8 weight percent or below, though stabler images can still be obtained during extended periods of operation because of the high durability of the toners, a large amount of toner is required to obtain an image having a certain density, so that it is economically disadvantageous. If the density is 20 weight % or below, it is possible to prevent a decrease in the fusing and charging properties.

Besides the binding resin and the colorant, the toner particles of the present invention may include other additives, such as charge controlling agents, waxes or the like, for example. The charge controlling agent for a color toner is preferably a quaternary ammonium salt in the case of a positive charge controlling agent, and is preferably an achromatic charge controlling agent such as a metal salt of alkyl salicylic acid in the case of a negatively charged controlling agent.

A method of producing the toner particles of the present invention includes dry blending of the primary components, i.e., the binding resin and the pigment (colorant), or a so-called master batch composition having the pigment (colorant) dispersed in the binding resin in advance, in a mixer with additives such as a charge controlling agent, waxes, and a dispersing agent, if necessary; homogenously dispersing the additives by thermal melt kneading; grinding and classifying a resulting material. As the mixer, Henschel type mixers such as Henschel Mixer (manufactured by MITSUI MINING CO., LTD), Super Mixer (manufactured by Kawata Co., Ltd.), Mechanomill (manufactured by Okada Seiko) and the like may be used. Alternatively, Ongmill (manufactured by Hosokawa Micron Corporation), Hybridization System (manufactured by NARA MASCHINERY CO., LTD.), Cosmo System (Kawasaki Heavy Industries, Ltd.) or the like may be used. As a kneader, an extruder with one or two axes, such as TEM-100B (manufactured by TOSHIBA MASCHINE CO., LTD.), PCM-65/87 (manufactured by Ikegai Co., Ltd.), and the like for example, or a kneader of an open roll type, such as Kneadex (manufactured by MITSUI MINING CO., LTD.) and the like may be used.

A melt kneading operation with a high shearing rate at a low temperature is particularly preferable in order to disperse the additives efficiently and to prevent the resin viscosity during the fusing from falling too much. From this reason, the kneader of an open roll type or the like is especially preferable.

For grinding of toner particles, an airflow impingement mill using a jet stream or a mechanical grinding mill may be used. The toner particles are adjusted to the particles with a predetermined grain size by the classification through the force of the aerial flow or the like. The ground toner particles may be obtained through polymerization, such as suspension by which the toner particles are obtained in an aqueous solution, emulsion aggregation, and fusion suspension and the like.

In addition, the toner particles of the present invention may be used, depending on its usage, by adding external additives such as a plasticizer, a charge adjuster, a surface resistance adjuster and the like. Examples of inorganic fine powders used for this purpose are, for example, silica fine powders, fine powders of titanium oxide, fine powders of alumina, and the like. For the purpose of hydrophobying and charge controlling, the inorganic fine powders may be processed, if necessary, by a finishing agent such as silicone varnish, various denatured silicone varnishes, silicone oil, various denatured types of silicone oil, silane coupling agent, silane coupling agent having a functional group, and other organic silicon compounds. Needless to say, more than two finishing agents may be used in combination, depending on the purpose.

As other additives, lubricants such as teflon, zinc stearate, polyvinylidende fluoride, particles of silicone oil (containing about 40% of silica), for example, are preferably used. A small amount of white particles having the reverse polarity with the toner particles may be used as a developing improver.

The carrier particles of the present invention are carrier particles coated with resin. In other words, according to the present invention, magnetic particles out of ferrite, ferric oxide, nickel, and the like which are coated with resin, are used as coated carrier particles. Such resin-coated carrier particles are advantageous with respect to durability since the magnetic particles are coated with resin.

Fluorocarbon resin, silicone resin, acrylic resin, and the like can be used as resin to coat the particles for the resin-coated carrier particles. Mixing ratio of the toner particles and the carrier particles for the two-component developer can be selected as appropriate, but is preferably between 1:99 and 15:85 in ratio by weight.

A mean volume particle diameter of the toner particles according to the present invention is between 5.5 μm and 7 μm, and a number percent of the toner particles with a mean volume particle diameter of 5 μm or below is, with respect to the total toner particles, in the range up to the limit represented by a numerical expression (1). Volume percent of the toner particles with a mean volume particle diameter between 8 μm and 12.7 μm, with respect to the total toner particles, is in the range between an upper limit represented by a numerical expression (2) and a lower limit represented by a numerical expression (3). The density of the carbon black pigments in the toner particles is between 8 weight percent and 20 weight percent. The carrier particles are resin coated carrier particles, and a mean volume particle diameter of the carrier particles is between 35 μm and 65 μm.

$$y=-15x+136 \quad (1),$$

$$n=15m-75 \quad (2), \text{ and}$$

$$n=7m-37 \quad (3),$$

in which x represents a mean volume particle diameter;

y represents a number percent of toner particles with a mean volume particle diameter of 5 μm or below;

m represents a mean volume particle diameter; and n represents a volume percent of toner particles with a mean volume particle diameter between 8 μm and 12.7 μm, respectively.

The "number percent" herein means the ratio (%) of the number of toner particles under consideration against the total number of toner particles. The "volume percent" herein means the ratio (%) of volume of toner particles under consideration out of the entire volumes of all of the toner particles.

As mentioned above, the toner particles in the two-component developing method are continually exposed to stress by being stirred with the carrier particles. Therefore, the toner particles in the two-component developer tend to break during extended periods of operation, so that toner spent and fog are caused, resulting in the deterioration of image quality. On the other hand, toner particles with small grain diameters and with high density of pigment are needed in recent years so as to improve image quality and to economize on toner consumption. Toner particles with small diameters are greatly aggregated and are easily scattered, which could cause toner spent and fog. Thus diameters of the toner particles are required to be controlled appropriately. The toner with a high density of pigments is easily cracked at the interface with the pigments, and is therefore less durable. Furthermore, as the number of toner particles with small diameters increases during extended periods of operation, toner filming or fog is more easily caused.

Accordingly, by appropriately controlling the grain size distribution of the toner particles and the grain size of the carrier particles, the two-component developer of the present invention having toner particles with small grain diameters and high density of pigment, can be realized so as not to cause image deterioration during extended periods of operation.

In other words, according to the present invention, as described in the following examples, if the ratio of toner particles with a mean volume particle diameter 5 μm or below is above the upper limit represented by the above-mentioned numerical expression (1), toner spent to the carrier particles are easily caused due to the presence of too many small particles, so that a charged level is changed or fog is caused. Accordingly, the image quality becomes deteriorated.

In addition, as described in the following examples, if the ratio of the toner particles with a mean volume particle diameter between 8 μm and 12.7 μm is above the upper limit represented by a numerical expression (2), the resolution becomes low due to the presence of too many coarse particles, resulting in the deterioration of image quality. On the other hand, if the ratio of the toner particles with a mean volume particle diameter between 8 μm and 12.7 μm is below the lower limit represented by a numerical expression (3), the durability of toner particles is low, resulting in the deterioration of image quality during extended periods of operation.

Therefore, in order to achieve the preferred effect according to the present invention, the toner particles are required to satisfy the above-mentioned numerical range.

In addition, the carrier particles of the two-component developer according to the present invention have a mean volume particle diameter between 35 μm and 65 μm. As shown in the following examples, if a mean volume particle diameter of the carrier particles is below 35 μm, the carrier particles tend to be scattered, resulting in deterioration of image quality. On the other hand, if a mean volume particle diameter of the carrier particles is above 65 μm, the entire surface area of the carrier particles becomes too small relating to the small toner particles with grain diameters between 5.5 μm and 7 μm, so that the toner particles cannot be frictionally charged in a homogeneous fashion. In particular, when the amount of fine powders increases during extended periods of operation, the influence due to the problems becomes noticeable, so that fog tends to occur easily.

Therefore, in order to achieve the preferred effect according to the present invention, the carrier particles are required to satisfy the above-mentioned numerical range.

Furthermore, according to the present invention, the toner particles are prepared by mixing two kinds of toner particles with different mean volume particle diameters, and a numerical expression a>b is preferably satisfied, in which a % is a ratio of the toner particles with a smaller mean volume particle diameter, and b % is a ratio of the toner particles with a greater mean volume particle diameter, with respect to the total toner particles, respectively.

From the expression a>b herein, it becomes apparent that a certain amount of coarse toner particles are added to toner particles with a certain grain diameter. By employing such toner particles, it is possible to obtain stabler image quality during extended periods of operation. The reason for this effect is not clearly known, but it is assumed that by employing a certain ratio of coarse toner particles, the coarse toner particles inserted between the carrier particles serve as spacers, decreasing the stress for the small toner particles. Even if the coarse toner particles break due to the stress, the influence of the broken coarse particles are limited because slightly smaller particles than the original coarse particles are produced by the breaking, and because the initial ratio of the coarse particles is anyway small.

The binding resin included in the toner particles of the present invention is in particular preferably polyester resin or polyether polyol resin. Polyester resin or polyol resin is more durable than other resins such as methyl methacrylate-styrene resin. Thus, the toners made of these resins are durable during extended periods of operation, so that a two-component developer with less image deterioration can be provided.

According to the present invention, an image formation method using the above-mentioned two-component developer is also provided. The image formation method according to the present invention does not differ from conventional image formation methods, except for using the above-mentioned two-component developer. Thus concrete steps are not limited and various steps offered in the conventional image formation methods may be employed.

For example, in an image formation method including: forming a latent image on a latent image carrier; forming a toner image on the latent image carrier, using a developer provided on a developer holder; transferring the toner image onto an image supporting member; and fusing the toner image on the image supporting member, the two-component developer according to the present invention can be used as a developer.

According to such an image formation method, high-quality images can be formed throughout a long time period, utilizing the merits of the two-component developer of the present invention.

As the present invention relates to a two-component developer used in an image formation apparatus such as a photoelectronic copier, a printer, and the like, industrial applicability can be found in production, purchase, and the like of such an image formation apparatus.

As mentioned above, by using the two-component developer according to the present invention, even if the toner has small grain diameters and a high density of pigments for economizing the toner consumption, cracking and toner spent caused by the stress from carrier particles are suppressed so that less deteriorated and stabler images can be obtained throughout a long time period. Likewise, the same effect can be obtained by the image formation method using the above-mentioned two-component developer.

Furthermore, the toner particles of the two-component developer according to the present invention, are prepared by mixing two kinds of toner particles with different mean volume particle diameters, and a numerical expression a>b is preferably satisfied, in which a % is a ratio of the toner particles with a smaller mean volume particle diameter, and b % is a ratio of the toner particles with a greater mean volume particle diameter, with respect to the total toner particles, respectively.

Toner particles of an appropriate grain distribution profile may be prepared by mixing two kinds of toners with different mean volume particle diameters. When mixing, the mixing ratio a>b is preferably satisfied where a % is a ratio of the toner particles with a smaller mean volume particle diameter, and b % is a ratio of the toner particles with a greater mean volume particle diameter, to the total toner particles, respectively.

By employing such toner particles, it is possible to obtain stabler image quality during extended periods of operation. The reason for this effect is not clearly known, but it is assumed that by employing a certain ratio of coarse toner particles, the coarse toner particles inserted between the carrier particles serves as spacers, decreasing the stress to the small toner particles. Even if the coarse toner particles break through stress, the influence on the image quality caused by the broken coarse particles are limited because slightly smaller particles than the original coarse particles are produced by the breaking, and because the initial ratio of the toner particles with great grain diameters is small anyway.

The binding resin in the two-component developer according to the present invention is preferably polyester resin or polyether polyol resin.

Polyester resin or polyol resin is more durable than other resins such as methyl methacrylate-styrene resin. Thus, the above-mentioned arrangement enables high durability during extended periods of operation, so that the two-component developer with less image deterioration can be provided.

In the following, examples are shown to illustrate the embodiments of the present invention in more detail. Needless to say, the invention is not limited to the following examples, and variations may be possible. Also the present invention is not limited to the above-mentioned embodiments, and variations are possible within the scope of the claims. Thus, any embodiment combining the technical means in the scope of the claims would be included within the scope of the claims.

EXAMPLES

In the following, the production method of the toner particles used in the examples of the present invention will be concretely described. First, the following were put in a henshell mixer: 66 part by weight of binding resin of polyether polyol resin with a glass transition temperature Tg of 61° C. and ½ flow softening temperature Tm of 117° C. (TPO-267 manufactured by Mitsui Chemicals Inc.); polyester resin with a glass transition temperature Tg of 60° C. and ½ flow softening temperature Tm of 105° C. (SE-123 manufactured by DAINIPPON INK AND CHEMICALS INC.); a kneaded material dispersed with 40 weight % of carbon black pigment by kneading in advance 25 part by weight of the carbon black pigment (pigment density: 10%); a charge-controlling agent (BONTRON E-84: a metal salt of alkyl salicylic acid manufactured by Orient Chemical Industries, Ltd.); and wax (product name: Polywax TM-500 manufactured by Toyo Petrolite Ltd.) The materials were mixed for 10 minutes so as to obtain the mixture of the materials.

The obtained mixture of the materials was dispersed by melt kneading at a preset temperature of 125° C. using Kneadex MOS140-800 manufactured by MITSUI MINING CO., Ltd. The obtained kneaded material was cooled down, crushed roughly, then ground into fine powders by a jet-type grinding mill, and subsequently classified by the force of aerial flow. An obtained toner as a result was a toner T-1 of 5.0 μm in mean volume particle diameter having no surface additives. The toner particles showed an almost normal distribution profile with a coefficient of variation of 26.

Under the same blending and melt kneading conditions as those for T-1 except for having modified the grinding and classifying steps of the kneaded material, a toner T-2 having no surface additives was generated. A mean volume particle diameter of the toner T-2 particles was 5.5 μm and the profile of grain diameter distribution was adjusted to show an almost normal distribution with a coefficient of variation of 22.

Under the same blending and melt kneading conditions as those for T-1 except for having modified the grinding and classifying steps of the kneaded material, a toner T-3 having no surface additives was generated. A mean volume particle diameter of the toner T-3 particles was 5.5 μm and the profile of grain diameter distribution was adjusted to show an almost normal distribution with a coefficient of variation of 25.

Under the same blending and melt kneading conditions as those for T-1 except for having modified the grinding and classifying steps of the kneaded material, a toner T-4 having no surface additives was generated. A mean volume particle diameter of the toner T-4 particles was 6.0 μm and the profile of grain diameter distribution was adjusted to show an almost normal distribution with a coefficient of variation of 22.

Under the same blending and melt kneading conditions as those for T-1 except for having modified the grinding and classifying steps of the kneaded material, a toner T-5 having no surface additives was generated. A mean volume particle diameter of the toner T-5 particles was 6.5 μm and the profile of grain diameter distribution was adjusted to show an almost normal distribution with a coefficient of variation of 20.

Under the same blending and melt kneading conditions as those for T-1 except for having modified the grinding and classifying steps of the kneaded material, a toner T-6 having no surface additives was generated. A mean volume particle diameter of the toner T-6 particles was 6.0 μm and the profile of grain diameter distribution was adjusted to show an almost normal distribution with a coefficient of variation of 22.

Under the same blending and melt kneading conditions as those for T-1 except for having modified the grinding and classifying steps of the kneaded material, a toner T-7 having no surface additives was generated. A mean volume particle diameter of the toner T-7 particles was 7.0 μm and the profile of grain diameter distribution was adjusted to show an almost normal distribution with a coefficient of variation of 25.

Under the same blending and melt kneading conditions as those for T-1 except for having modified the grinding and classifying steps of the kneaded material, a toner T-8 having no surface additives was generated. A mean volume particle diameter of the toner T-8 particles was 8.1 μm and the profile of grain diameter distribution was adjusted to show an almost normal distribution with a coefficient of variation of 21.

Under the same blending and melt kneading conditions as those for T-1 except for having modified the grinding and classifying steps of the kneaded material, a toner T-9 having no surface additives was generated. A mean volume particle diameter of the toner T-9 particles was 8.0 μm and the profile of grain diameter distribution was adjusted to show an almost normal distribution with a coefficient of variation of 25.

Under the same blending and melt kneading conditions as those for T-1 except for having modified the grinding and classifying steps of the kneaded material, a toner T-10 having no surface additives was generated. A mean volume particle diameter of the toner T-10 particles was 7.9 μm and the profile of grain diameter distribution was adjusted to show an almost normal distribution with a coefficient of variation of 30

Under the same blending and melt kneading conditions as those for T-1 except for having modified the grinding and classifying steps of the kneaded material, a toner T-11 having no surface additives was generated. A mean volume particle diameter of the toner T-11 particles was 9.1 μm and the profile of grain diameter distribution was adjusted to show an almost normal distribution with a coefficient of variation of 26.

Under the same blending and melt kneading conditions as those for T-1 except for having modified the grinding and classifying steps of the kneaded material, a toner T-12 having no surface additives was generated. A mean volume particle diameter of the toner T-12 particles was 9.0 μm and the profile of grain diameter distribution was adjusted to show an almost normal distribution with a coefficient of variation of 30.

Under the same blending and melt kneading conditions as those for T-1 except for having modified the grinding and classifying steps of the kneaded material, a toner T-13 having no surface additives was generated. A mean volume particle diameter of the toner T-13 particles was 10.1 μm and the profile of grain diameter distribution was adjusted to show an almost normal distribution with a coefficient of variation of 25.

Under the same blending and melt kneading conditions as those for T-1 except for having modified the grinding and classifying steps of the kneaded material, a toner T-14 having no surface additives was generated. A mean volume particle diameter of the toner T-14 particles was 5.1 μm and the profile of grain diameter distribution was adjusted to show an almost normal distribution with a coefficient of variation of 25.

Under the same blending and melt kneading conditions as those for T-1 except for having modified the grinding and classifying steps of the kneaded material, a toner T-15 having no surface additives was generated. A mean volume particle diameter of the toner T-15 particles was 7.5 μm and the profile of grain diameter distribution was adjusted to show an almost normal distribution with a coefficient of variation of 19.

Under the same blending and melt kneading conditions as those for T-1 except for having modified the grinding and classifying steps of the kneaded material, a toner T-16 having no surface additives was generated. A mean volume particle diameter of the toner T-16 particles was 3.1 μm and the profile of grain diameter distribution was adjusted to show an almost normal distribution with a coefficient of variation of 35.

Under the same blending and melt kneading conditions as those for T-1 except for having modified the grinding and classifying steps of the kneaded material, a toner T-17 having no surface additives was generated. A mean volume particle diameter of the toner T-2 particles was 7.6 μm and the profile of grain diameter distribution was adjusted to show an almost normal distribution with a coefficient of variation of 17.

Under the same blending and melt kneading conditions as those for T-1 except for having modified the grinding and classifying steps of the kneaded material, a toner T-18 having no surface additives was generated. A mean volume particle diameter of the toner T-18 particles was 3.0 μm and the profile of grain diameter distribution was adjusted to show an almost normal distribution with a coefficient of variation of 26.

The obtained toners having no surface additives were mixed in the ratio as shown in the following TABLE 1. Each of the 100 part by weight mixed toners having no surface additives was mixed with 2 kinds of hydrophobic silica fine powders treated by hexamethyldisilazane (1.5 part by weight in total, which consisted of 1.0 part by weight of RX-200 manufactured by NIPPON AEROSIL CO., LTD. and 0.5 part by weight of RX-50 manufactured by NIPPON AEROSIL CO., LTD.), so that frictionally charged negative toners were obtained. The grain diameters of the obtained toners were measured by a Coulter multisizer II. The measurement result is shown in TABLE 1.

TABLE 1

Distribution of Grain Diameters of Prepared Toners

| EXAMPLE | TONER A (PART BY WEIGHT) | TONER B (PART BY WEIGHT) | GRAIN DIAMETER (μm) | COEFFI-CIENT OF VARIATION | NUMBER % OF PARTICLES ≦5 μm | VOLUME % OF PARTICLES 8-12.7 μm |
|---|---|---|---|---|---|---|
| EXAMPLE1 | T-1(100) | T-7(50) | 5.6 | 27 | 55 | 3.9 |
| EXAMPLE2 | T-1(100) | T-7(90) | 5.9 | 27 | 46 | 5.1 |
| EXAMPLE3 | T-2(100) | T-8(40) | 6.0 | 26 | 41 | 9.5 |
| EXAMPLE4 | T-3(100) | T-10(50) | 6.2 | 28 | 42 | 11 |
| EXAMPLE5 | T-4(100) | T-11(20) | 6.3 | 25 | 34 | 12 |
| EXAMPLE6 | T-2(100) | T-8(40) | 6.4 | 26 | 34 | 14 |
| EXAMPLE7 | T-4(100) | T-9(40) | 6.5 | 24 | 30 | 9.8 |
| EXAMPLE8 | T-3(100) | T-10(90) | 6.6 | 27 | 34 | 15 |
| EXAMPLE9 | T-4(100) | T-12(40) | 6.6 | 27 | 32 | 18 |
| EXAMPLE10 | T-4(100) | T-11(60) | 6.8 | 26 | 26 | 25 |
| EXAMPLE11 | T-4(100) | T-9(80) | 6.8 | 28 | 24 | 15 |
| EXAMPLE12 | T-4(100) | T-12(60) | 6.9 | 27 | 28 | 24 |
| EXAMPLE13 | T-5(100) | T-11(40) | 7.0 | 23 | 18 | 21 |
| COMP. EXAMPLE1 | T-15(100) | T-16(80) | 5.9 | 41 | 50 | 9.8 |
| COMP. EXAMPLE2 | T-15(100) | T-16(60) | 6.4 | 39 | 44 | 11 |
| COMP. EXAMPLE3 | T-15(100) | T-16(40) | 6.8 | 36 | 36 | 13 |
| COMP. EXAMPLE4 | T-17(100) | T-18(90) | 5.6 | 41 | 56 | 9.2 |
| COMP. EXAMPLE5 | T-17(100) | T-18(70) | 6.3 | 40 | 45 | 11 |
| COMP. EXAMPLE6 | T-17(100) | T-18(50) | 6.7 | 37 | 38 | 12 |
| COMP. EXAMPLE7 | T-1(100) | — | 5.0 | 26 | 76 | 0.2 |
| COMP. EXAMPLE8 | T-2(100) | — | 5.5 | 22 | 53 | 0.1 |
| COMP. EXAMPLE9 | T-3(100) | — | 5.5 | 25 | 61 | 0.3 |
| COMP. EXAMPLE10 | T-4(100) | — | 6.0 | 22 | 41 | 1.0 |
| COMP. EXAMPLE11 | T-5(100) | — | 6.5 | 20 | 25 | 3.3 |
| COMP. EXAMPLE12 | T-6(100) | — | 7.0 | 19 | 14 | 8.6 |
| COMP. EXAMPLE13 | T-1(100) | T-7(20) | 5.2 | 27 | 66 | 1.5 |
| COMP. EXAMPLE14 | T-1(100) | T-11(50) | 5.7 | 34 | 51 | 21 |
| COMP. EXAMPLE15 | T-1(100) | T-11(80) | 6.3 | 33 | 42 | 28 |
| COMP. EXAMPLE16 | T-1(100) | T-11(100) | 6.9 | 32 | 38 | 32 |
| COMP. EXAMPLE17 | T-6(100) | T-14(90) | 6.0 | 25 | 41 | 2.8 |
| COMP. EXAMPLE18 | T-6(100) | T-14(50) | 6.4 | 25 | 34 | 5.7 |
| COMP. EXAMPLE19 | T-6(100) | T-14(10) | 6.9 | 21 | 19 | 7.8 |
| COMP. EXAMPLE20 | T-1(100) | T-13(100) | 7.3 | 35 | 38 | 43 |
| COMP. EXAMPLE21 | T-5(100) | T-11(70) | 7.4 | 23 | 15 | 28 |

FIG. 1(*a*) is a graph with a vertical axis showing a number percent of toner particles with a mean volume particle diameter of 5 μm or below, and with a horizontal axis showing a mean volume particle diameter, where values of the examples 1 through 13 and values of comparative examples 1 through 6 are plotted. FIG. 1(*b*) is a graph with a vertical axis showing a volume percent of toners particles with a mean volume particle diameter between 8 μm and 12.7 μm, and with a horizontal axis showing a mean volume particle diameter, where values of the examples 1 through 13 and values of comparative examples 1 through 21 are plotted.

As shown in TABLE 1 and FIGS. 1(*a*) and 1(*b*), a ratio of toner particles with small grain diameters is relatively high and the grain diameters are also widely distributed with respect to the toners in the comparative examples 1 through 6, so that the number percent of the particles of 5 μm or below is greater than that of the toner in the examples.

Each of the toners in the comparative examples 7 through 12 have toner particles with a single grain size, respectively, and the toner particles are distributed in a narrow range, so that the volume percent of the toner particles with a mean volume particle diameter between 8 μm and 12.7 μm is low.

Each of the toners in the comparative examples 7 and 13 have toner particles with small grain diameters, so that a number percent of particles of 5 μm or below is higher, and a volume percent of the particles with a mean volume particle diameter between 8 μm and 12.7 μm is lower, compared with corresponding values of the toners in the examples.

Each of the toners in comparative examples 20 and 21 has toner particles with great grain diameters, so that a volume percent of the particles with a mean volume particle diameter between 8 μm and 12.7 μm is higher than the values of the toners in the examples.

With respect to the toners in comparative examples 8 through 12 and 17 through 19, a volume percent of the particles with a mean volume particle diameter between 8 μm and 12.7 μm is lower than that of the toners in the examples.

With respect to the toners in comparative examples 14 through 16, a volume percent of the toner particles with a mean volume particle diameter between 8 μm and 12.7 μm is higher than that of the toners in the examples.

Next, each of the toners obtained through the above-mentioned method was mixed with silicon-coated ferrite carrier particles with a mean volume particle diameter of 50 μm by adjusting toner density to be 5 weight percent, so that a two-component developer was obtained. Then, evaluation images were formed by using AR-705S manufactured by SHARP CORPORATION (processing speed: 395 mm/sec).

The formed evaluation images were evaluated with respect to image density and fog in the following manner. With respect to "image density", comparison was carried out between the initial image density and the image density after printing a manuscript with a print coverage rate of 5% on 200,000 sheets of papers with an intermission every 5 sheets. The "image density" was measured by RD-914, a Macbeth reflection density meter (manufactured by GratagMacbeth Co., Ltd.). If the value of image density after printing 200,000 sheets is below 1.3, the example corresponding to the evaluation image was marked in the TABLE 1 as "x" with respect to the image density. If the value was 1.3 or above, the mark is "O".

With respect to "fog", the toner was left untouched for 17 hours after the initial setting of the developer, and then the replenishment time was measured. The fog on a blank area of paper at the time of printing after 17 hours was also measured by a Hunter whiteness meter (manufactured by NIPPON DENSHOKU INDUSTRIES CO., LTD.) If the fog value on the blank area was below 1.0, the example corresponding to the evaluation image is marked as "0" for the fog section. If the value was 1.0 or above and below 1.5, the mark is "A". If the value was 1.5 or above, the mark is "x".

With respect to "image quality evaluation (dot reproductivity)", a pattern having one on-dot followed by one-off dot was printed. If the printed result reproduced on/off dot pattern keeping an identical interval, the dot reproductivity section in the TABLE corresponding to the example was marked with "O". If on/off intervals are varied despite being capable of correcting each dot, the mark is "Δ". If more than two dots were found to be stuck together, and each dot was not reproduced clearly, the mark is "x".

The result of the above-mentioned evaluation is shown below in the following TABLE 2.

TABLE 2

Result of the Image Evaluation

| | BEFORE PRINTING | | | AFTER 200000 SHEETS PRINT | | | |
|---|---|---|---|---|---|---|---|
| | IMAGE DENSITY | FOG | DOT REPRODUCTIVITY | IMAGE DENSITY | FOG | DOT REPRODUCTIVITY | OVERALL EVALUATION |
| EXAMPLE1 | 1.75(○) | 0.48(○) | ○ | 1.71(○) | 0.64(○) | ○ | ○ |
| EXAMPLE2 | 1.68(○) | 0.45(○) | ○ | 1.65(○) | 0.51(○) | ○ | ○ |
| EXAMPLE3 | 1.65(○) | 0.32(○) | ○ | 1.60(○) | 0.49(○) | ○ | ○ |
| EXAMPLE4 | 1.65(○) | 0.38(○) | ○ | 1.62(○) | 0.45(○) | ○ | ○ |
| EXAMPLE5 | 1.60(○) | 0.32(○) | ○ | 1.55(○) | 0.38(○) | ○ | ○ |
| EXAMPLE6 | 1.62(○) | 0.28(○) | ○ | 1.60(○) | 0.33(○) | ○ | ○ |
| EXAMPLE7 | 1.52(○) | 0.34(○) | ○ | 1.45(○) | 0.48(○) | ○ | ○ |
| EXAMPLE8 | 1.50(○) | 0.31(○) | ○ | 1.48(○) | 0.39(○) | ○ | ○ |
| EXAMPLE9 | 1.45(○) | 0.29(○) | ○ | 1.41(○) | 0.32(○) | ○ | ○ |
| EXAMPLE10 | 1.48(○) | 0.35(○) | ○ | 1.40(○) | 0.41(○) | ○ | ○ |
| EXAMPLE11 | 1.43(○) | 0.32(○) | ○ | 1.38(○) | 0.30(○) | ○ | ○ |
| EXAMPLE12 | 1.45(○) | 0.27(○) | ○ | 1.41(○) | 0.30(○) | ○ | ○ |
| EXAMPLE13 | 1.43(○) | 0.25(○) | ○ | 1.49(○) | 0.27(○) | ○ | ○ |
| COMP. EXAMPLE1 | 1.45(○) | 1.23(Δ) | ○ | 1.18(x) | 1.08(Δ) | Δ | X |
| COMP. EXAMPLE2 | 1.37(○) | 1.12(Δ) | ○ | 1.21(x) | 0.85(○) | Δ | X |
| COMP. EXAMPLE3 | 1.33(○) | 1.08(Δ) | ○ | 1.10(x) | 0.78(○) | Δ | X |
| COMP. EXAMPLE4 | 1.41(○) | 1.27(Δ) | ○ | 0.95(x) | 0.79(○) | ○ | X |
| COMP. EXAMPLE5 | 1.34(○) | 1.22(Δ) | ○ | 1.01(x) | 0.97(○) | Δ | X |
| COMP. EXAMPLE6 | 1.35(○) | 1.34(Δ) | ○ | 0.97(x) | 1.28(Δ) | Δ | X |
| COMP. EXAMPLE7 | 1.78(○) | 1.12(Δ) | ○ | 1.86(○) | 1.88(x) | ○ | X |
| COMP. EXAMPLE8 | 1.69(○) | 0.67(○) | ○ | 1.60(○) | 1.58(x) | ○ | X |
| COMP. EXAMPLE9 | 1.69(○) | 1.03(Δ) | ○ | 1.70(○) | 1.62(x) | ○ | X |
| COMP. EXAMPLE10 | 1.59(○) | 0.32(○) | ○ | 1.65(○) | 1.52(x) | ○ | X |

TABLE 2-continued

| | Result of the Image Evaluation | | | | | | |
|---|---|---|---|---|---|---|---|
| | BEFORE PRINTING | | | AFTER 200000 SHEETS PRINT | | | |
| | IMAGE DENSITY | FOG | DOT REPRODUCTIVITY | IMAGE DENSITY | FOG | DOT REPRODUCTIVITY | OVERALL EVALUATION |
| COMP. EXAMPLE11 | 1.47(○) | 0.38(○) | ○ | 1.40(○) | 1.24(Δ) | ○ | X |
| COMP. EXAMPLE12 | 1.38(○) | 0.48(○) | ○ | 1.25(x) | 1.08(Δ) | ○ | X |
| COMP. EXAMPLE13 | 1.66(○) | 1.05(Δ) | ○ | 1.60(○) | 1.58(x) | ○ | X |
| COMP. EXAMPLE14 | 1.60(○) | 0.55(○) | Δ | 1.69(○) | 0.69(○) | X | X |
| COMP. EXAMPLE15 | 1.48(○) | 0.45(○) | Δ | 1.52(○) | 0.52(○) | X | X |
| COMP. EXAMPLE16 | 1.35(○) | 0.39(○) | Δ | 1.39(○) | 0.49(○) | X | X |
| COMP. EXAMPLE17 | 1.61(○) | 1.12(Δ) | ○ | 1.68(○) | 1.65(x) | ○ | X |
| COMP. EXAMPLE18 | 1.54(○) | 0.40(○) | ○ | 1.69(○) | 1.51(x) | Δ | x |
| COMP. EXAMPLE19 | 1.39(○) | 0.39(○) | ○ | 1.45(○) | 1.27(Δ) | Δ | x |
| COMP. EXAMPLE20 | 1.18(x) | 0.38(○) | Δ | 1.25(x) | 0.48(○) | X | x |
| COMP. EXAMPLE21 | 1.10(x) | 0.22(○) | Δ | 1.05(x) | 0.32(○) | X | X |

As apparent from the above-mentioned result, each of the toners in the comparative examples has at least one problem, either in "image density", "fog" or "evaluation of image (dot reproductivity)". On the other hand, the toners in the examples show high quality in all aspects of "image density", "fog" and "evaluation of image (dot reproductivity)".

Furthermore, using the toner in Example 3 (mean volume particle diameter=6.0 μm), another evaluation was carried out in the same manner as that in Example 1 except that the carrier was replaced by a ferrite core carrier with various mean diameters. The carrier types and the result of the evaluation are shown in the following TABLE 3.

TABLE 3

| | Carrier Types and Result of the Evaluation | | | | | | | | |
|---|---|---|---|---|---|---|---|---|---|
| | CARRIER | | BEFORE PRINTING | | | AFTER 200000 SHEETS PRINTING | | | |
| EXAMPLE | GRAIN DIAMETER (μm) | W(or W/O) RESIN COATING | IMAGE DENSITY | FOG | DOT REPRO-DUCTIVITY | IMAGE DENSITY | FOG | DOT REPRO-DUCTIVITY | OVERALL EVALUATION |
| EXAMPLE3 | 50 | W | 1.65(○) | 0.32(○) | ○ | 1.60(○) | 0.49(○) | ○ | ○ |
| EXAMPLE14 | 41 | W | 1.59(○) | 0.29(○) | ○ | 1.32(○) | 0.35(○) | ○ | ○ |
| EXAMPLE15 | 62 | W | 1.66(○) | 0.42(○) | ○ | 1.69(○) | 0.45(○) | ○ | ○ |
| COMP. EXAMPLE22 | 30 | W | 1.45(○) | 1.11(Δ) | Δ | 1.34(○) | 1.19(Δ) | Δ | x |
| COMP. EXAMPLE23 | 75 | W | 1.38(x) | 0.69(○) | ○ | 1.10(x) | 1.14(Δ) | Δ | X |
| COMP. EXAMPLE24 | 105 | W | 0.95(x) | 1.05(Δ) | Δ | 0.82(x) | 1.61(x) | x | x |
| COMP. EXAMPLE25 | 50 | W/O | 1.56(○) | 0.44(○) | ○ | 0.52(x) | 1.98(x) | Δ | x |

As is apparent from the above-mentioned result, also in the cases employing the carriers with different mean diameters, each of the toners in the comparative examples have at least one problem, either in "image density", "fog" or "evaluation of image (dot reproductivity)". On the other hand, the toners in the examples show high quality in all aspects of "image density", "fog" and "evaluation of image (dot reproductivity)".

From the above-mentioned evaluation result, the boundary between the examples and the comparative examples is set. As shown in FIGS. 1(*a*) and 1(*b*), a two-component developer having values within the following ranges is preferable for achieving the object of the present invention: a number percent of toner particles with a mean volume particle diameter of 5 μm or below, with respect to the total toner particles, is in the range up to the limit represented by a numerical expression (1); a volume percent of toner particles with a mean volume particle diameter between 8 μm and 12.7 μm, with respect to the total toner particles, is in the range between an upper limit represented by a numerical expression (2) and a lower limit represented by a numerical expression (3); and $$y=-15x+136 \quad (1),$$

$$n=15m-75 \quad (2), \text{ and}$$

$$n=7m-37 \quad (3),$$

in which x represents a mean volume particle diameter;

y represents a number percent of toner particles with a mean volume particle diameter of 5 μm or below;

m represents a mean volume particle diameter; and n represents a volume percent of toner particles with a mean volume particle diameter between 8 μm and 12.7 μm, respectively.

Accordingly, by employing the two-component developer having toners within the ranges of the present invention, even if the toner has small grain diameters and a high density of pigments for economizing the toner consumption, cracking and toner spent caused by the stress from carrier particles are suppressed so that less deteriorated and stabler images can be obtained throughout a long time period.

The embodiments and concrete examples of implementation discussed in the above detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

What is claimed is:

1. A two-component developer comprising toner particles and carrier particles, wherein:

the mixing ratio of the toner particles to the carrier particles is between 1:99 and 15:85 in ratio by weight;

the toner particles contain at least a binding resin and a carbon black pigment, a charge control agent and external additives; wherein the external additives contain silica fine powders and do not contain fine powders of titanium oxide;

a mean volume particle diameter of the toner particles is between 5.5 μm and 7 μm;

a number percent of the toner particles with a mean volume particle diameter of 5 μm or below, with respect to the total toner particles, is in the range up to the limit represented by a numerical expression (1);

a volume percent of the toner particles with a mean volume particle diameter between 8 μm and 12.7 μm, with respect to the total toner particles is in the range between an upper limit represented by a numerical expression (2) and a lower limit represented by a numerical expression (3);

density of the carbon black pigments in the toner particles is between 8 weight percent and 20 weight percent;

carrier particles are resin coated carrier particles;

a mean volume particle diameter of the carrier particles is between 35 μm and 65 μm; and $$y=-15x+136 \quad (1),$$

$$n=15m-75 \quad (2), \text{ and}$$

$$n=7m-37 \quad (3),$$

in which x represents a mean volume particle diameter;

y represents a number percent of toner particles with a mean volume particle diameter of 5 μm or below;

m represents a mean volume particle diameter; and n represents a volume percent of toner particles with a mean volume particle diameter between 8 μm and 12.7 μm, respectively, the toner particles consist of first toner particles and second toner particles, wherein said first toner particles and said second toner particles are of different mean volume particle diameters so that a condition a>b is satisfied; in which:

a % is the ratio of said first and second toner particles with the smaller mean volume particle diameter and b % is the ratio of the other of said first and second toner particles with the greater mean volume particle diameter, with respect to the toner particles, respectively.

2. The two-component developer according to claim 1, wherein the binding resin is polyester resin or polyether polyol resin.

3. An image formation method comprising the steps of:

forming a latent image on a latent image carrier;

forming a toner image on the latent image carrier, using a developer provided on a developer holder;

transferring the toner image onto an image supporting member; and fusing the toner image on the image supporting member, wherein:

the developer is a two-component developer comprising toner particles and carrier particles;

the toner particles contain at least a binding resin and a carbon black pigment, a charge control agent and external additives; wherein the external additives contain silica fine powders and do not contain fine powders of titanium oxide;

a mean volume particle diameter of the toner particles is between 5.5 μm and 7 μm;

a number percent of the toner particles with a mean volume particle diameter of 5 μm or below , with respect to the total toner particles, is in the range up to the limit represented by a numerical expression (1);

a volume percent of the toner particles with a mean volume particle diameter between 8 μm and 12.7 μm, with respect to the total toner particles, is in the range between an upper limit represented by a numerical expression (2) and a lower limit represented by a numerical expression (3);

density of the carbon black pigments in the toner particles is between 8 weight percent and 20 weight percent;

carrier particles are resin coated carrier particles;

a mean volume particle diameter of the carrier particles is between 35 μm and 65 μm; and $$y=-15x+136 \quad (1),$$

$$n=15m-75 \quad (2), \text{ and}$$

$$n=7m-37 \quad (3),$$

in which x represents a mean volume particle diameter;

y represents a number percent of toner particles with a mean volume particle diameter of 5 μm or below;

m represents a mean volume particle diameter; and n represents a volume percent of toner particles with a mean volume particle diameter between 8 μm and 12.7 μm, respectively, the mixing ratio of the toner particles to the carrier particles is between 1:99 and 15:85 in ratio by weight, the toner particles consist of first toner particles and second toner particles, wherein said first toner particles and said second toner particles are of different mean volume particle diameters so that a condition a>b is satisfied ; in which:

a % is the ratio of said first and second toner particles with the smaller mean volume particle diameter and b % is the ratio of the other of said first and second toner particles with the greater mean volume particle diameter, with respect to the toner particles, respectively.

* * * * *